US007036672B2

(12) United States Patent
Jaycox

(10) Patent No.: US 7,036,672 B2
(45) Date of Patent: May 2, 2006

(54) METHODS AND APPARATUS FOR SHIPPING MEDICAL SUBSTANCES

(76) Inventor: Donald L. Jaycox, 3923 Tamara Trail, Wildwood, MO (US) 63069

( * ) Notice: Subject to any disclaimer, the term of this patent is extended or adjusted under 35 U.S.C. 154(b) by 0 days.

(21) Appl. No.: 10/680,746

(22) Filed: Oct. 7, 2003

(65) Prior Publication Data

US 2005/0072124 A1 Apr. 7, 2005

(51) Int. Cl.
*B65D 55/02* (2006.01)

(52) U.S. Cl. ..... 215/222; 215/217

(58) Field of Classification Search ..... 53/490, 53/130.1, 133.1, 133.3, 133.4; 215/222, 215/217; 220/293, 298, 300, 301, 296
See application file for complete search history.

(56) References Cited

U.S. PATENT DOCUMENTS 3,399,796 A * 9/1968 Steiner ..... 215/216
3,447,709 A * 6/1969 Marasco ..... 215/221
3,613,928 A * 10/1971 Landen ..... 215/214
3,703,974 A * 11/1972 Boxer et al. ..... 215/217
3,840,143 A * 10/1974 Davis et al. ..... 220/288
3,880,313 A * 4/1975 Akers ..... 215/211
3,951,289 A * 4/1976 Landen ..... 215/211
4,037,747 A * 7/1977 Acton et al. ..... 215/219
4,852,560 A * 8/1989 Hermann et al. ..... 600/575
5,727,704 A * 3/1998 Glynn ..... 215/223
5,938,055 A * 8/1999 Philips et al. ..... 215/222

* cited by examiner

*Primary Examiner*—Stephen F. Gerrity
*Assistant Examiner*—Brian Nash
(74) *Attorney, Agent, or Firm*—Armstrong Teasdale LLP

(57) ABSTRACT

A packaging system includes an elongate vessel and a lid. The vessel includes a bottom wall, a top surface, and a cylindrical body between the top surface and bottom wall. The body includes an outer surface, a tapered inner surface, and a vertical portion. The vertical portion extends between the tapered inner surface and the top surface. The vessel further includes a plurality of locking tabs formed on the outer surface. The lid includes a cylindrical body, an interior perimeter and an inner surface, and an inner sealing ring extending from the inner surface and configured to engage and seal against the vertical portion of the elongate vessel. The lid also includes an outer sealing ring extending down from the inner surface and out from the interior perimeter, a plurality of tab receptacles positioned within the lid cylindrical body, and a plurality of notches within the cylindrical body positioned between the plurality of tab receptacles. The tab receptacles are configured to receive the plurality of locking tabs.

4 Claims, 6 Drawing Sheets

METHODS AND APPARATUS FOR SHIPPING MEDICAL SUBSTANCES

BACKGROUND OF THE INVENTION

This invention relates generally to packaging systems and, more particularly, to containers for shipping medical substances.

Biotechnology and medical research have led to the development of new medical substances which require extensive testing and verification. Often, the research facilities are located at different locations other than the testing or verification facilities. Accordingly, the medical substances must be transported between various locations. In order to protect the public, prevent contamination of the substance, and to ensure that the substances are safely transported from one location to another, intricate packaging systems are used to ensure that the substances do not escape into the environment. Current packaging systems rely on an absorbent material or fill to help prevent leakage, and thus virtually concede that some amount of spillage will occur during shipping. Accordingly, a separate liquid tight container must also be used to ensure that none of the leaked substances escape to the environment. Additionally, once the absorbent material or fill is contaminated with the medical substance, an additional disposal problem is created. As a result, packaging systems in use today are typically very complicated and expensive.

BRIEF DESCRIPTION OF THE INVENTION

In one aspect, a packaging system for shipping substances is provided which includes a packaging container for storing substances during shipping. The packaging container comprises an elongate vessel comprising a bottom wall, a top surface, and a cylindrical body extending from the bottom wall to the top surface. The cylindrical body comprises an outer surface, a tapered inner surface, and a vertical portion which extends between the tapered inner surface and the top surface. The vessel comprises a plurality of locking tabs formed on the outer surface. The lid comprises a cylindrical body, an interior perimeter and an inner surface, and an inner sealing ring extending from the inner surface and configured to engage and seal against the vertical portion of the elongate vessel. The lid also comprises an outer sealing ring extending down from the inner surface and out from the interior perimeter, a plurality of tab receptacles positioned within the lid cylindrical body, and a plurality of notches within the cylindrical body positioned between the plurality of tab receptacles. The tab receptacles receive the plurality of locking tabs.

In another aspect, a vessel is provided that comprises a bottom wall, a top surface, and a cylindrical body extending between the bottom wall and top surface. The cylindrical body comprises an outer surface, a tapered inner surface and a vertical portion, the vertical portion extending between the tapered inner surface and the top surface. The tapered inner surface extends from the bottom wall to the vertical portion. The vessel also comprises a plurality of locking tabs extending from the outer surface.

In still another aspect, a method for sealing a container is provided. The container includes an elongate vessel and a lid, the vessel including a bottom wall, a top surface, a cylindrical body extending between the bottom wall and the top surface, the cylindrical body including an outer surface, a tapered inner surface and a vertical portion. The vertical portion extends between the tapered inner surface and the top surface, the tapered inner surface extending from the bottom wall to the vertical portion. The vessel includes a plurality of locking tabs mounted to the outer surface. The lid includes an inner surface and an interior perimeter, a cylindrical body extending from the top wall, a plurality of tab receptacles positioned within the lid cylindrical body, and an inner sealing ring extending from the inner surface. The method comprises placing the substance within the elongate vessel, engaging the inner sealing ring of the lid against the vertical portion of the vessel to form a seal, and receiving the locking tabs in the receptacles utilizing a plurality of notches on an outer surface of the lid, the notches positioned between the receptacles.

DETAILED DESCRIPTION OF THE INVENTION

Figure 1:
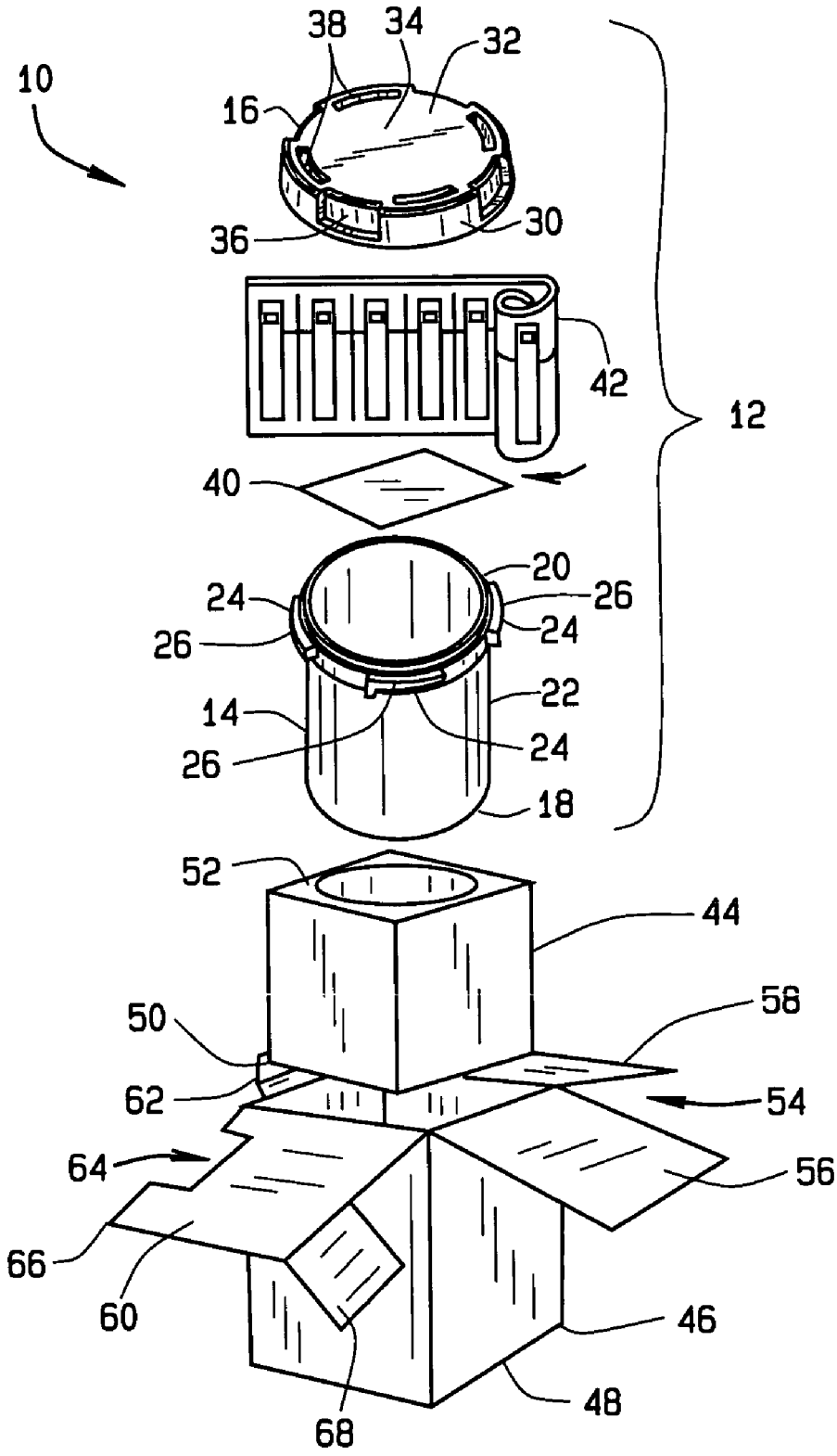
FIG. 1 is an exploded perspective view of a packaging system.

FIG. 1 is an exploded perspective view of a packaging system 10 used to ship medical or other substances (not shown). Packaging system 10 includes a packaging container 12 for storing the medical substances during shipping. Packaging container 12 includes an elongate vessel 14 and a lid 16. Vessel 14 has a first end 18 and a second end 20. First end 18 includes a bottom wall (not shown in FIG. 1) and second end 20 is open to provide access to a hollow cylindrical body 22. Vessel 14 also includes a plurality of locking tabs 24 formed on cylindrical body 22 in close proximity to second end 20. Locking tabs 24 extend radially outward from cylindrical body 22 and are received in a plurality of tab receptacles (not shown in FIG. 1) disposed within lid 16 when lid 16 is fully secured to vessel 14. In one embodiment, locking tabs 24 also include a locking indentation 26 which is formed approximate a center of locking tab 24.

Lid 16 includes a cylindrical body 30 and a top wall 32. Top wall 32 has an inner surface (not shown in FIG. 1) and an outer surface 34. Cylindrical body 30 includes a plurality of indentations 36 which, in at least one embodiment, allows a user to apply more torque to lid 16 when securing lid 16 to vessel 14. Lid 16 also includes a plurality of openings 38 which extend inward from outer surface 34. The tab receptacles are sized and spaced to receive locking tabs 24, and in one embodiment are located beneath openings 38. The tab receptacles permit lid 16 to be properly oriented above vessel 14. Additionally, the locking receptacles secure lid 16 to vessel 14 when lid 16 is properly positioned with respect to vessel 14 and lid 16 is rotated a portion of a complete revolution.

Packing system 10 also includes a pad 40, a protective wrap 42, an insulator 44, and a shipping carton 46. Pad 40 is positioned within vessel 14 adjacent the bottom wall and beneath the medical substances being shipped. Pad 40 provides a nominal amount of shock-absorbency to the medical substances and is constructed of an absorbent material, which will contain any leakage seeping from the medical substances being shipped. In one embodiment, pad 40 is constructed from a cotton and gauze material. Protective wrap 42 is also positioned within vessel 14 adjacent pad 40 and surrounds the medical substance being shipped. Wrap 42 provides an insulating barrier between the medical substance and an inner surface (not shown) of vessel 14 cylindrical body 30. Wrap 42 is constructed of a shock-absorbent material, which limits the movement of the medical substance within vessel 14. In one embodiment, wrap 42 is constructed of a bubble wrap material.

Insulator 44 is constructed of a shock-absorbent material which is sized to fully occupy and fit snugly within a shipping carton 46. Shipping carton 46 surrounds insulator 44. In one embodiment, insulator 44 is constructed from expanded flexible polyurethane foam. Insulator 44 is die-cut such that a bottom end 50 is solid and a top end 52 is hollow. Packaging container 12 is inserted within second end 52 such that insulator 44 tightly envelops vessel 14 and provides a degree of insulation and shock-absorbency between packaging container 12 and shipping carton 46. Additionally, insulator 44 is cut to fit snuggly within shipping carton 46. Accordingly, insulator 44 prohibits packaging vessel 14 from shifting within shipping carton 46 during shipping. Other embodiments exist where one or more of adjacent pad 40, protective wrap 42, and insulator 44 are not utilized with shipping carton 46, vessel 14, and lid 16.

Shipping carton 46 is constructed from a heavy fiberboard material and in one embodiment is constructed of 200 pound burst B-flute corrugated material with weather resistant corrugating adhesive. Shipping carton 46 includes an outer top cover 54 which includes a first inner panel 56, a second inner panel 58, a third panel 60 and an integral locking panel 62. Inner panel 56 and inner panel 58 are folded over insulator top end 52 after insulator 44 is placed within shipping carton 46. Third panel 60 includes a notch 64 along an inner side 66 which after third panel 60 is folded over insulator accepts locking panel 62. Third panel 60 also includes an integral locking flap 68 which, when used in combination with locking panel 62, securely locks outer top cover 54 in a closed position such that shipping carton 46 is in compliance with United States and International regulations regarding the shipment of medical substances. In another embodiment, inner panel 56 is configured with a hole therethrough which engages lid 16 when vessel 14 and lid 16 are inserted into shipping carton 46. In such an embodiment, an insert (not shown) with a hole formed therein may be placed inside, at a bottom 48 of shipping carton 46 where the hole is to be engaged by first end 18 of vessel 14 as vessel 14 is inserted into shipping carton 46. In another embodiment, bottom 48 of shipping carton 46 includes panels similar to panels 56, 58, 60, and 62, where one or more of the inner panels can be figured with holes for insertion of vessel 14.

Figure 2:
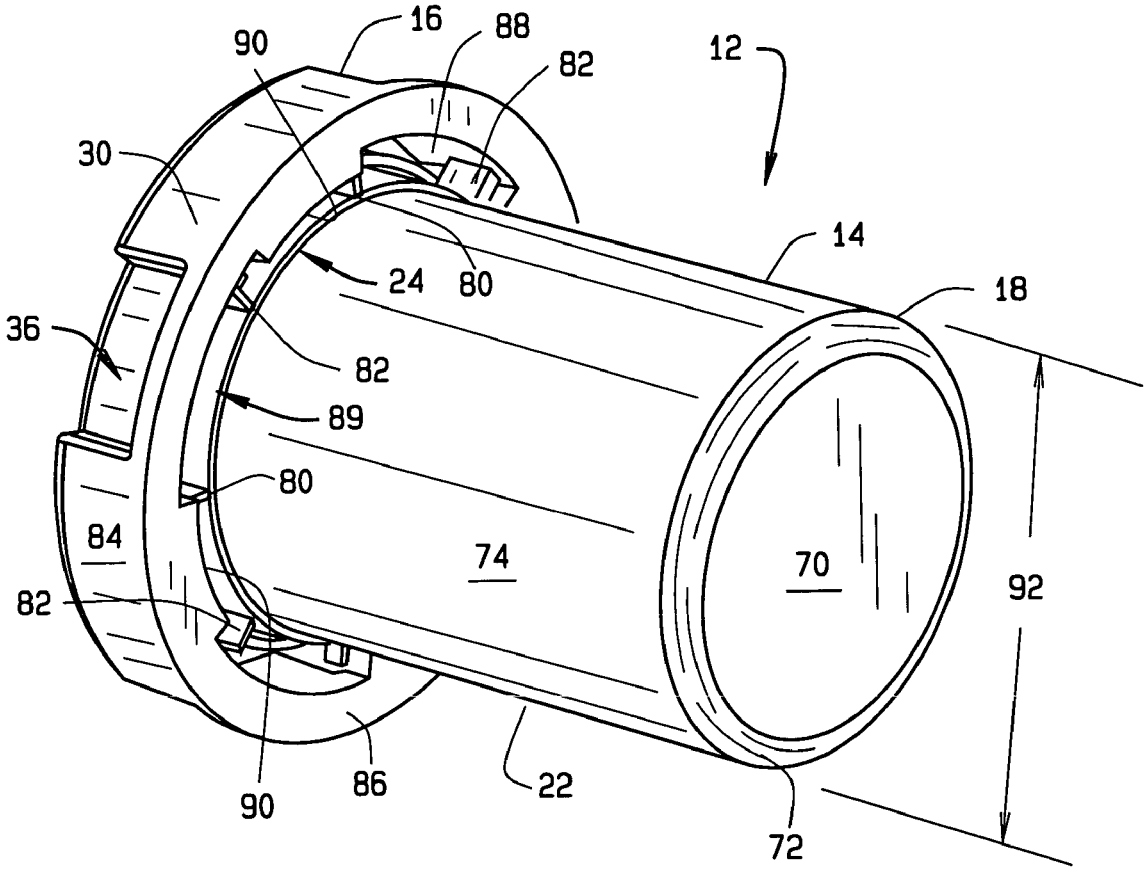
FIG. 2 is a perspective view of a packaging container used in the packaging system shown in FIG. 1.

FIG. 2 is a perspective view of packaging container 12 including vessel 14 and lid 16. A bottom wall 70 is disposed at vessel second end 20 and in one embodiment includes a beveled lip 72 which provides a transition surface between bottom wall 70 and cylindrical body 22. In another embodiment, the transition between bottom wall 70 and cylindrical body 22 is substantially square. Bottom wall 70 includes an outer surface 72 and an inner surface (not shown). Cylindrical body 22 includes an outer surface 74 and an inner surface (not shown in FIG. 2). Locking tabs 24 are extend from cylindrical body 22 outer surface 74. Locking tabs 24 include a first end 80, a second end 82, and a first member (not shown in FIG. 2) extending therebetween.

Lid 16 includes a top wall 32 (not shown in FIG. 2) and a cylindrical body 30 which extends from top wall 32. Cylindrical body 30 includes an outer surface 84, a bottom surface 86, and an interior perimeter 88. Outer surface 84 includes indentations 36 which allows the user to apply more torque to lid 16 when securing lid 16 to vessel 14. Bottom surface 86 includes a plurality of notches 89 positioned beneath indentations 36. A plurality of tab receptacles 90 are disposed within lid 16 and are circumferentially positioned between indentations 36 and notches 89 on interior perimeter 88 and form a portion of bottom surface 86. Cylindrical body 22 has a diameter 92 which may taper slightly from second end 20 to first end 18. Lid 16 is sized to fit snugly over vessel 14 such that when lid 16 is fully secured, interior perimeter 88 is positioned substantially at diameter 92, a surface of lid 16 engages a top surface 94 of vessel 14, and locking tabs 24 are received in tab receptacles 90.

Figure 3:
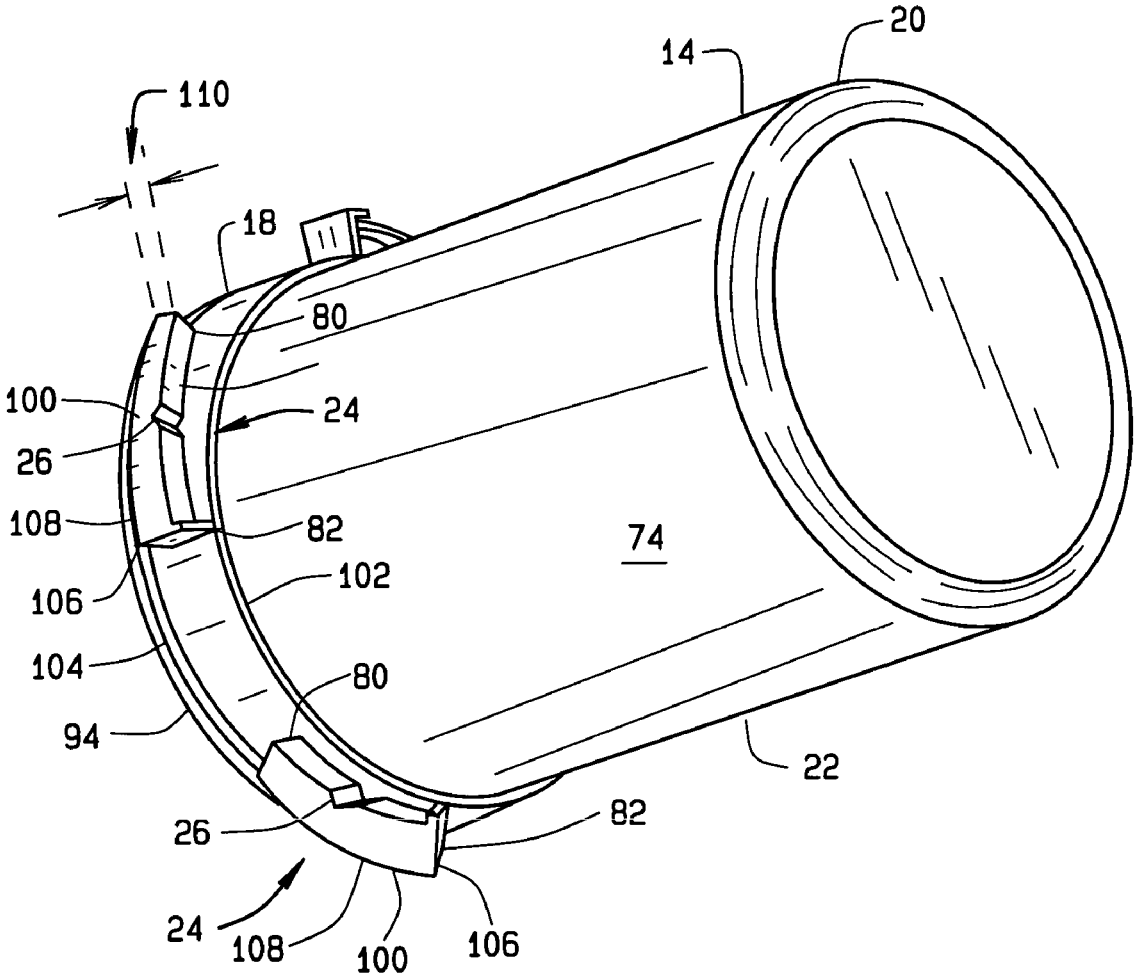
FIG. 3 is a perspective view of a vessel which forms a portion of the packaging container of FIG. 2.

FIG. 3 is a perspective view of vessel 14 including first end 18 and second end 20. Second end 20 is open and includes a plurality of locking tabs 24. Locking tabs 24 include a first end 80, a second end 82, and a first member 100 extending therebetween. Second end 82 includes an "L-shaped" member 106. In one embodiment (not shown), locking tabs 24 are mounted to and extend radially outward from cylindrical body 22 outer surface 74. In another embodiment as shown in FIG. 3, vessel 14 includes a perimeter ring 102 extending from outer surface 74, and locking tabs 24 extend out from perimeter ring 102. A top 104 of perimeter ring 102 is co-planar with a top 108 of first member 100 forming a secondary sealing surface shown in FIG. 4). When lid 16 is installed upon vessel 14, locking tab 24 is rotated along one of tab receptacles 90 (not shown in FIG. 3) positioned within lid 16 causing a portion of lid 16 to engage the secondary sealing surface as further described below. After lid 16 is rotated a portion of a complete revolution, "L-shaped" member 106 contacts tab receptacles 90 and prevents lid from rotating further.

First member 100 extends between first end 80 and second end 82 and is curved such that first member 100 conforms to cylindrical body 22 outer surface 74. First member 100 is circumferentially tapered from second end 82 to first end 80. First member 100 has a first thickness 110 that extends along the length of locking tabs 24. Additionally, the tapering of first member 100 draws the lid tighter against vessel 14 while lid 16 is being secured to vessel 14. First member 100 further includes a locking indentation 26 (also shown in FIG. 1). In the embodiment shown, locking indentation 26 is substantially V-shaped. Locking indentation 26 is engaged by an engaging member (shown in FIG. 5) formed on cap 16 to further provide protection from lid 16 disengaging from vessel 14 and therefore protecting against leakage from vessel 14 as internal pressures increase.

Figure 4:
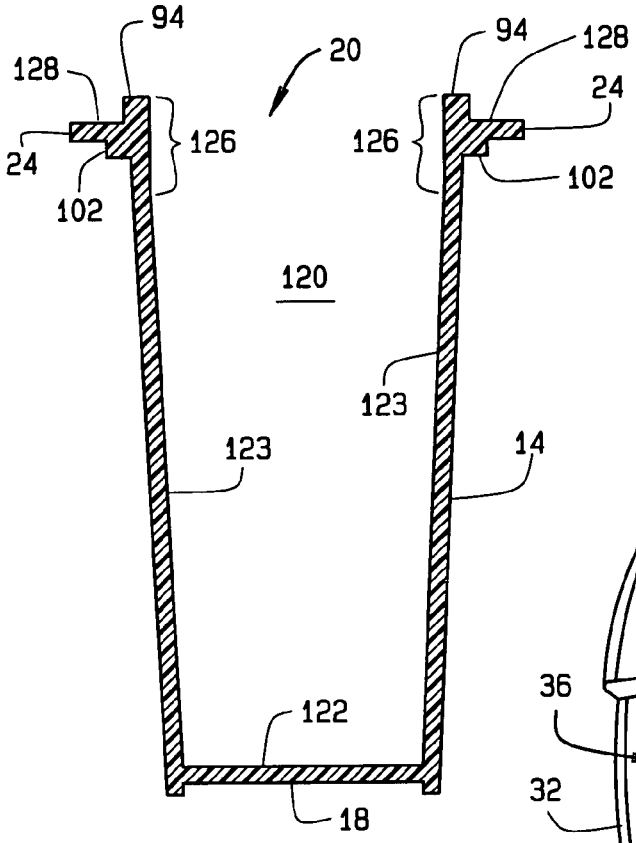
FIG. 4 is a cross-sectional view of the vessel of FIG. 3.

FIG. 4 is a cross-sectional view of vessel 14 illustrating an inner portion 120 bounded by a bottom surface 122 and inner wall 123. A diameter of inner portion 120 decreases slightly from first end 18 to second end 20 which is sometimes described herein as being slightly tapered. Starting at top surface 94 and extending a distance into inner portion 120 a non-tapered, vertical section 126 is formed for providing a seal with lid 16. In one embodiment, vertical section 126 is machined to provide the sealing surface for lid 16, as further described below. Top surface 94 further provides a sealing surface which engages a sealing slot (shown in FIG. 7) in lid 16. Locking tabs 24 are shown extending from perimeter ring 102 forming secondary sealing surface 128.

Figure 5:
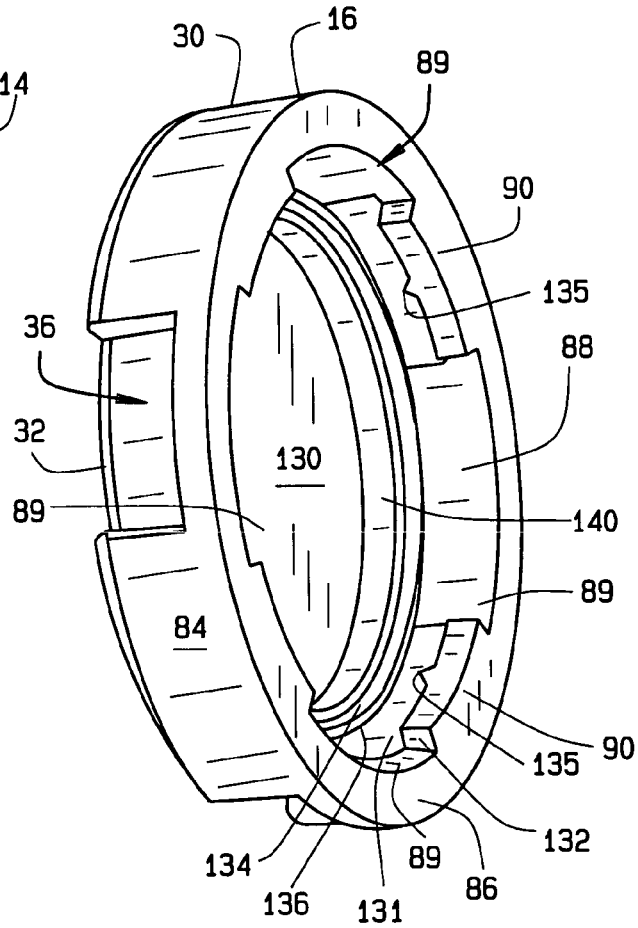
FIG. 5 is a perspective bottom view of a lid which forms a portion of the packaging container of FIG. 2.

FIG. 5 is a perspective bottom view of lid 16 including cylindrical body 30 and top wall 32 and which further includes an inner surface 130. Cylindrical body interior perimeter 88 includes tab receptacles 90 extending therefromwhich are spaced circumferentially between notches 89 in bottom surface 86 and indentations 36 in cylindrical body 30. Tab receptacles 90 result in a sleeve 131 being formed along interior perimeter 88 which is sized to receive the locking tabs 24 (shown in FIG. 3). Sleeve 131 is formed between a shoulder 132 formed integrally with bottom surface 86 and interior perimeter 88 and an outer sealing ring 134 formed within cylindrical body interior perimeter 88. Tab receptacles 90 further include indentation engaging members 135 which, in the embodiment shown, are V-shaped and configured to engage locking indentation 26 (shown in FIG. 3) of vessel 14 (shown in FIGS. 3 and 4).

Outer sealing ring 134 provides a top surface of sleeve 131 and provides a mating surface 136 to seal against secondary sealing surface 128 (shown in FIG. 4) of vessel 14 when lid 16 is fully installed upon vessel 14 (shown in FIG. 3). An inner sealing ring 140 is circumferentially mounted to lid 16 and extends from inner surface 120. Inner sealing ring 140 is configured to engage vertical section 126 of vessel 14 when lid 16 is fully installed upon vessel 14, providing a surface to surface seal. As pressure within sealed vessel 14 increases, the pressure also affects inner sealing ring 140, causing inner sealing ring 140 to be more forcefully pushed against vertical section 126, thereby strengthening the seal.

The above described vessel 14 to lid 16 locking arrangement helps to maintain the inner sealing ring 140 against vertical section 126 seal by securely maintaining the engagement between the two. When lid 16 is being installed upon vessel 14, locking tabs 24 are initially received in notches 89. As a rotational force is applied to engage lid 16 with vessel 14, the rotation forces locking tabs 24 to engage along tab receptacles 90 thereby causing indentation engaging members 135 into locking indentations 26. As lid 16 is rotated, tab receptacles 90 force lid 16 to tighten, against vessel 14 and force outer sealing ring 134 to seal against vessel 14. As engaging members 135 engage locking indentations 26, second end 82 (shown in FIG. 3) strikes against tab opening shoulder 132 fully securing lid 16 to vessel 14.

Figure 6:
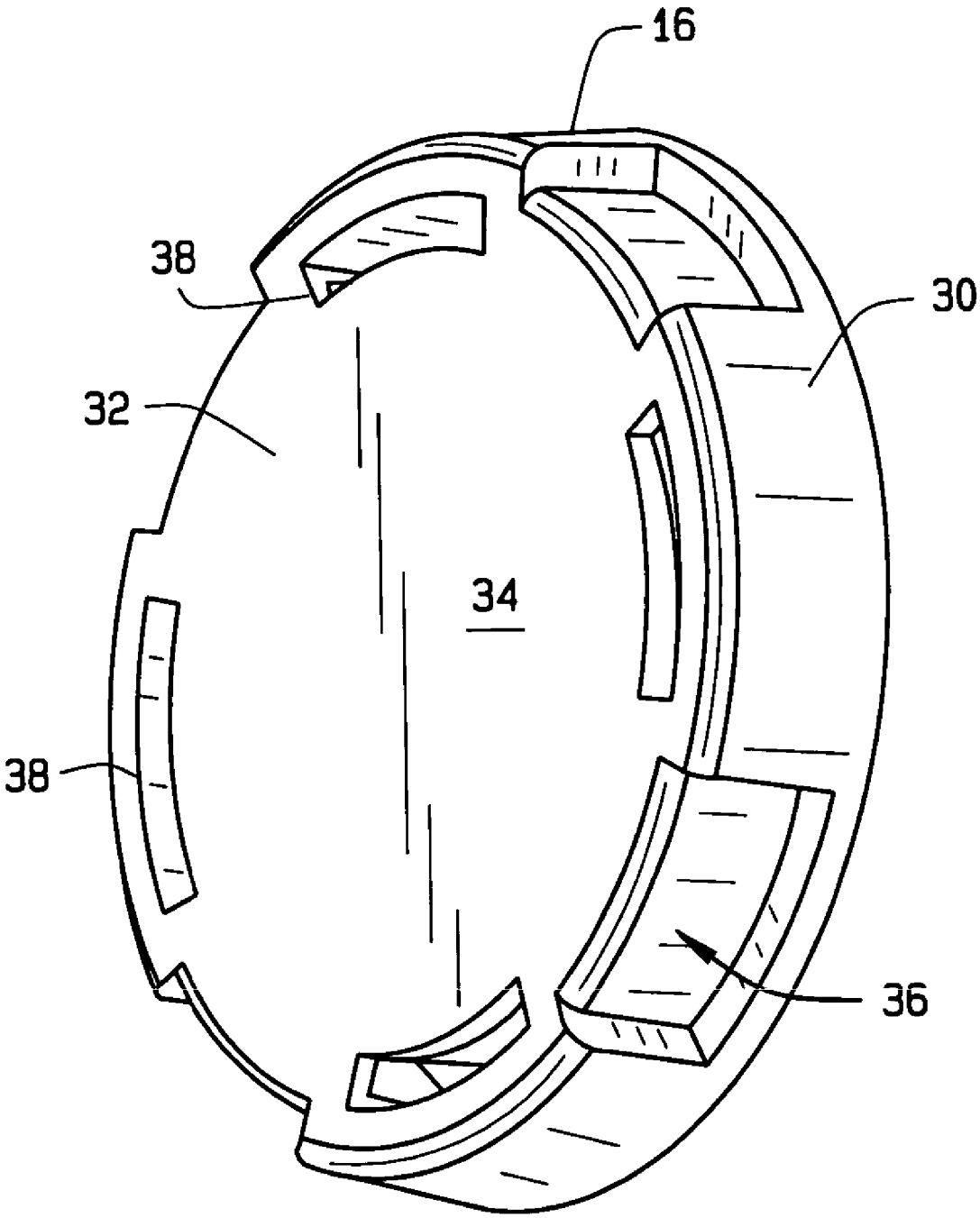
FIG. 6 is a perspective top view of the lid of FIG. 5.

FIG. 6 is a perspective top view of lid 16 including cylindrical body 30 and top wall 32 which includes an outer surface 34. Outer surface 34 includes receptacles 38 which extend inward from top surface 34 and are positioned above tab receptacles 90 (shown in FIG. 5). Cylindrical body 30 includes indentations 36 which extend from cylindrical body 30 upward to top outer surface 34. Indentations 36 include a tamper-proof/resistant feature (not shown). After lid 16 is fully secured to vessel 14, a tamper resistant seal (not shown) is installed through an opening (not shown) which extends through one notch 36 preventing lid 16 from being removed without the tamper resistant seal being broken.

Figure 7:
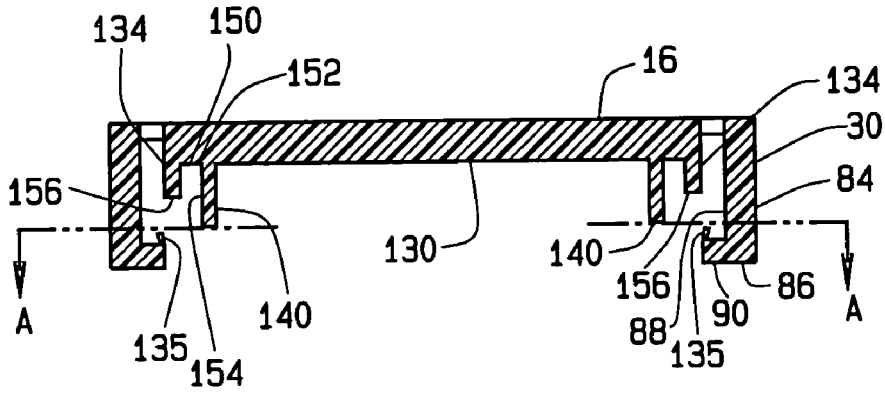
FIG. 7 is a side cross-sectional view of the lid of FIG. 5.

FIG. 7 is a cross-sectional view of lid 16. As described above, cylindrical body 30 includes outer surface 84, bottom surface 86, and interior perimeter 88. Tab receptacles 90 extend inward along bottom surface 86 from outer surface 84 for engagement with locking tabs 24 (shown in FIG. 3). Outer sealing ring 134 extends out from interior perimeter 88 and downward from inner surface 130 and inner sealing ring 140 extends downward from inner surface 130 to form a sealing slot 150. A bottom 156 of outer sealing ring engages secondary sealing surface 128 (shown in FIG. 4) of vessel 14. When engaged to vessel 14 (shown in FIG. 3) a horizontal surface 152 of sealing slot 150 contacts top surface 94. As described above, inner sealing ring 140 provides a seal for vessel 14 as vertical section 126 (shown in FIG. 4) is positioned against sealing surface 154. Inner sealing ring 140, and therefore sealing surface 154 are of a length such that some vertical movement of lid 16 with respect to vessel does not result in a loss of the seal formed by sealing surface 154 and vertical section 126. Further, the seal formed by sealing surface 154 and vertical section 126 eliminate a need for an O-ring, gasket, or other sealing mechanism. In one specific embodiment, vessel 14 is formed from polycarbonate and lid 16 is formed from polypropylene. Sealing is improved as the polypropylene is somewhat softer than polycarbonate, and slightly more sensitive to heat and pressure, which further improves sealing properties between vertical section 126 of vessel 14 and sealing surface 154 of lid 16.

While illustrated in the Figures as having four tab receptacles 90 for drawing clarity, lid 16 can be configured with any number of tab receptacles 90 that conform to the number of locking tabs 24 on vessel 14. In a specific embodiment, lid 16 is configured with eight tab receptacles 90 and a corresponding vessel similar to vessel 14 is configured with eight locking tabs 24.

Figure 8:
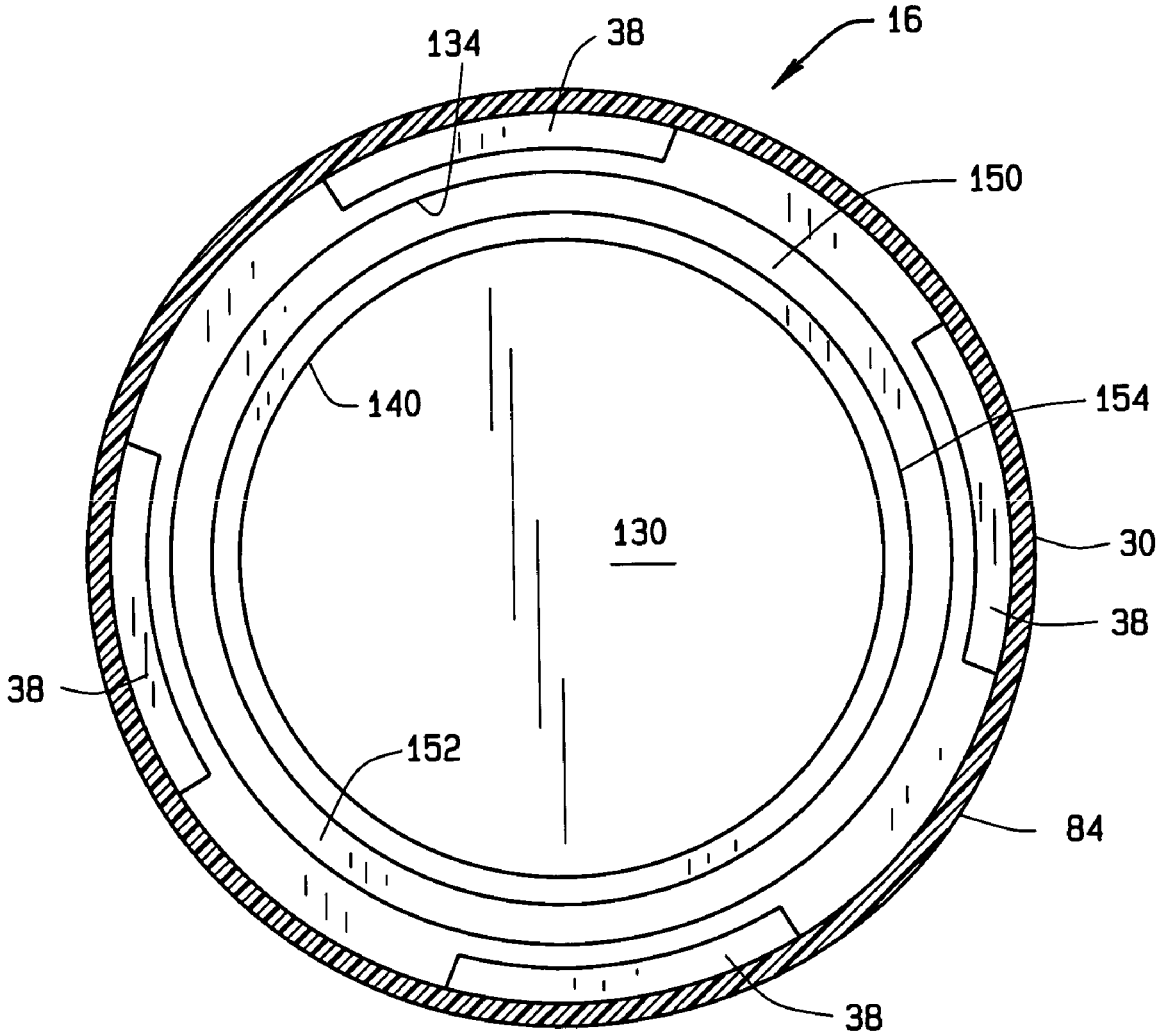
FIG. 8 is a bottom cross-sectional view of the lid of FIG. 5.

FIG. 8 is a bottom cross-sectional view of lid 16 along line A—A as shown in FIG. 7. Lid 16 is illustrated without tab receptacles 90 (shown in FIG. 7) for clarity. If shown completely, lid 16 would include four tab receptacles 90 which be vertically aligned with openings 38 which extend through an upper surface of lid 200. As described above, lid 16 includes a cylindrical body 30 that includes outer surface 84. Lid 16 further includes outer sealing ring 134 and inner sealing ring 140 which extend downward from inner surface 130 to form sealing slot 150. When engaged to vessel 14 (shown in FIG. 3) horizontal surface 152 of sealing slot 150 contacts top surface 94 (shown in FIG. 3) of vessel 14. As described above, inner sealing ring 140 provides a seal for vessel 14 as its outer diameter, sealing surface 154 is positioned against vertical section 126 (shown in FIG. 4) of vessel 14. In one embodiment, inner sealing ring 140, and therefore sealing surface 154 are of a length such that some vertical movement of lid 16 with respect to vessel does not result in a loss of the seal formed by sealing surface 154 and vertical section 126. Further, the seal formed by sealing surface 154 and vertical section 126 and also formed by horizontal surface 152 and top surface 94 eliminate any need for an O-ring, gasket, or other sealing mechanism as described above.

While illustrated in the various Figures as having four or eight tab receptacles 90 for drawing clarity, lid 16 can be configured with any number of tab receptacles 90 that conform to the number of locking tabs 24 on vessel 14 while still providing the sealing qualities herein described. In a specific embodiment, lid 16 is configured with eight tab receptacles 90 and vessel 14 is configured with eight locking tabs 24.

The above described packaging system can be utilized for shipping of medical substances and diagnostic and infectious specimens and is cost-effective and highly reliable. The system includes a packaging container which includes a lid and a vessel, each including sealing surfaces, which in combination with one another attach to provide an air tight seal without the use of any external hardware such as O-rings or gaskets. Although O-rings or gaskets are not utilized, the shipping container still meets the 95 kilopascal (approximately 14 pounds per square inch) internal pressure requirements for shipping containers as described in 49 C.F.R. §173.196(a)(6) and International Civil Aviation Organization/International Air Transport Association (ICAO/IATA) packing instruction 650. The pressure seal is created by placed sealing surface 154 of inner sealing ring 140 of lid 16 against vertical section 126 of vessel 14. As pressure inside vessel 14 increases, the seal between inner sealing ring 140 and vertical section 126 becomes tighter. Vessel 14 further withstands all performance standards as described in 49 C.F.R. §178.609 and ICAO/IATA 6.6.1. and 6.6.2 without any additional cushioning inserts. The above described vessel 14 and lid 16 further allow for easy opening and positive closure. Accordingly, a cost effective and reliable packaging system for shipping medical substances is provided.

While the invention has been described in terms of various specific embodiments, those skilled in the art will recognize that the invention can be practiced with modification within the spirit and scope of the claims.

What is claimed is:

1. A packaging system for shipping substances comprising:

a packaging container for storing substances during shipping, said packaging container comprising:

an elongate vessel comprising a bottom wall, a top surface, a cylindrical body extending from said bottom wall to said top surface, said cylindrical body comprising an outer surface, a tapered inner surface, and a vertical portion, said vertical portion extending between said tapered inner surface and said top surface, said vessel comprising a plurality of locking tabs formed on said outer surface, said locking tabs extend radially outward from a perimeter ring formed on said outer surface, said locking tabs, comprising a top, a first end, a second end, and a first member therebetween, said perimeter ring comprising a top, said locking tab top and said perimeter ring top being co-planar and forming a secondary sealing surface; and a lid comprising a cylindrical body, an interior perimeter and an inner surface, an inner sealing ring extending from said inner surface and configured to engage and seal against said vertical portion of said elongate vessel, an outer sealing ring extending down from said inner surface and between said inner sealing ring and said cylindrical body of said lid, a plurality of tab receptacles positioned within said lid cylindrical body, and a plurality of notches within said cylindrical body positioned between said plurality of tab receptacles, said tab receptacles configured to receive said plurality of locking tabs, said outer sealing ring engages said secondary sealing surface.

2. A packaging system in accordance with claim 1 wherein said locking tabs comprise a locking indentation formed in said first member and said tab receptacles comprise an indentation engaging member formed therein, said indentation engaging member and said locking indentation engaging one another when said lid is attached to said vessel.

3. A packaging system in accordance with claim 1 wherein said elongate vessel comprises a polycarbonate and said lid comprises polypropylene.

4. A packaging system in accordance with claim 1 wherein to provide a sealing surface to engage said lid, said vertical portion comprises a surface that has been smoothed utilizing a machining process.

* * * * *